United States Patent [19]

Yeoman

[11] Patent Number: 4,547,540

[45] Date of Patent: Oct. 15, 1985

[54] CORROSION PROTECTION IN COOLING WATER SYSTEMS

[75] Inventor: Alan M. Yeoman, Naperville, Ill.

[73] Assignee: Nalco Chemical Company, Oak Brook, Ill.

[21] Appl. No.: 514,422

[22] Filed: Jul. 18, 1983

Related U.S. Application Data

[63] Continuation-in-part of Ser. No. 374,550, May 3, 1982, abandoned.

[51] Int. Cl.[4] ..... C08K 5/16; C09K 3/00; C23F 11/00

[52] U.S. Cl. ..... 524/130; 252/389 R; 524/136; 524/139

[58] Field of Search ..... 524/136, 139, 130

[56] References Cited

U.S. PATENT DOCUMENTS

| | | | |
|---|---|---|---|
| 3,886,204 | 5/1975 | Geffers et al. | 252/106 |
| 3,886,205 | 5/1975 | Geffers et al. | 252/174.16 |
| 3,959,168 | 5/1976 | Germscheid et al. | 252/180 |
| 4,255,259 | 3/1981 | Hwa et al. | 210/699 |
| 4,288,327 | 9/1981 | Godlewski et al. | 210/698 |
| 4,306,991 | 12/1981 | Hwa et al. | 252/180 |

*Primary Examiner*—Herbert S. Cockeram

*Attorney, Agent, or Firm*—John G. Premo; Robert A. Miller; Donald G. Epple

[57] ABSTRACT

A composition and method for inhibiting ferrous metal corrosion in aqueous systems consisting essentially of (A) a copolymer of styrene sulfonic acid and maleic anhydride or maleic acid, and (B), water-soluble salts of said copolymer; and (C) a blend of two phosphonates consisting of (1) 2-phosphonobutane-1,2,4-tricarboxylic acid and (2) one member of the group consisting of (a) aminotrimethylene phosphonic acid and (b) hydroxy ethylidene diphosphonic acid. A preferred dosage, based on the active ingredient, is 7.5 ppm of styrene sulfonic acid/maleic anhydride copolymer and 6.0 ppm of phosphonate (1) and either 3.5 ppm of phosphonate (2a) of 4.2 ppm of phosphonate (2b). This relationship can be maintained during a total dosage of 0.01 to 500 ppm.

3 Claims, No Drawings

CORROSION PROTECTION IN COOLING WATER SYSTEMS

This application is a continuation-in-part of copending Ser. No. 374,550 filed May 3, 1982, now abandoned.

INTRODUCTION

The present invention relates to the inhibition of ferrous metal corrosion in circulating water and once-through systems such as cooling towers. The patent art is well developed and the present invention lies in the discovery that a combination of a duo of phosphonates added to a greater amount of a sulfonated styrene-maleic anhydride copolymer gave a result akin to synergism in protecting metal against corrosion.

This invention relates to a composition and method for inhibiting ferrous metal corrosion in an aqueous system consisting essentially of a copolymer of styrene sulfonic acid and maleic anhydride or a maleic acid, and water soluble salts of said copolymers, and a blend of two phosphonates consisting of (1) 2-phosphonobutane-1,2,4-tricarboxylic acid; and (2) one member of a group consisting of (a) aminotrimethylene phosphonic acid and (b) hydroxy ethylidene diphosphonic acid.

The results by standard corrosion tests on heat transfer specimen are set out in the Example and show superior results for the sulfonated styrene maleic anhydride polymer plus a blend of two phosphonates set out as this invention.

The dosage or percentiles are noted to be 0.01–500 ppm, or optionally about 7.5 ppm, of a copolymer of styrene sulfonic acid or sulfonated styrene copolymerized with maleic anhydride, mixed or blended with a total of about 9.5–10.2 ppm of a mixture of (1) 2-phosphonobutane-1,2,4-tricarboxylic acid and (2) either (a) aminomethylene phosphonic acid or (b) hydroxyethylidene diphosphonic acid, wherein (1) is about 6 ppm, (2a) is about 3.5 ppm and (2b) is about 4.2 ppm, based on active ingredients. In the dosage range of 0.01–500 ppm the relationship is about 1:1 of the styrene maleic to total phosphonate and 7.5 of sulfonated styrene maleic to 6 of phosphonate (1) and 3.5 of phosphonate (2a) and 4.2 of phosphonate (2b). Thus broadly, the present invention is applicable to a preferred dosage of about 7.5–15 ppm of the copolymer of styrene sulfonic acid or sulfonated styrene copolymerized with maleic anhydride or maleic acid mixed or blended with 9.5–20.4 ppm of a blend of phosphonate compounds, one of which is 6 to 12 ppm of a mixture of 2-phosphonobutane-1,2,4-tricarboxylic acid and 3.5–8.4 ppm of either aminotrimethylene phosphonic acid (AMP) or hydroxyethylidene diphosphonic acid (HEDP).

PRIOR ART STATEMENT

The starting materials are well known in the art. Versa TL-4, produced by the Proctor Company, a subsidiary of National Starch, is designated as a copolymer of styrene sulfonic acid with maleic anhydride, U.S. Pat. No. 4,255,259 Hwa, hereinafter incorporated by reference. The ratio of the styrene sulfonic acid to maleic anhydride in the copolymer is shown in the art as 50–95 in weight percent in U.S. Pat. No. 4,306,991, hereinafter incorporated by reference, and in the present invention it has been found that a ratio of 25–95 is operable.

The 2-phosphonobutane-1,2,4-tricarboxylic acid is described in U.S. Pat. No. 3,886,204, hereinafter incorporated by reference.

Dequest-2000 made by Monsanto Company, St. Louis, Missouri, or alternatively Fostex-U, is described as aminotrimethylene phosphonate (cf. U.S. Pat. No. 3,959,168). Dequest-2010, made by the Monsanto Company, St. Louis, Missouri, is described as hydroxyethylidene 1,1-diphosphonic acid (cf. U.S. Pat. No. 3,959,168).

Additionally, as art related to the blending of phosphonates: U.S. Pat. No. 3,959,168 Germscheid et al notes that a phosphonate of the type (a) 1-hydroxyethane-1,1-diphosphonic acid and its alkali metal and ammonium salts and (b) aminotrimethylene phosphonic acid with alkali metal and ammonium salts and (c) a phosphono polycarboxylic acid may be blended and alleges synergism.

U.S. Pat. No. 4,288,327 Godlewski et al (Betz Laboratories) teaches sulfonated styrene-maleic anhydride copolymers where styrene/maleic is 4:1 to 2:1.

U.S. Pat. No. 4,306,991 Hwa teaches a copolymer of styrene sulfonic acid and maleic anhydride or maleic acid along with a water-soluble organic phosphonic acid compound.

The present invention differs from the above blends in that it carries with it a component of styrene sulfonic acid-maleic anhydride copolymer or like compound plus at least two different phosphonate treating agents.

As additives it has been found advisable in some cases to add small quantities of Tolytriazole and a surfactant such as Diacid 1550 and Pluronic L-62.

Tolytriazole is explained in Hackh's Chemical Dictionary, 4th edition, page 91 (cf. benzotriazole) and is generally employed as a corrosion inhibitor for copper surfaces in contact with water.

Pluronic L-62 is a water soluble dispersant which is an ethylene oxide-propylene oxide block copolymer formed by condensing ethylene oxide with propylene glycol and is manufactured by BASF Wyandotte. The Pluronic L-62 is available and useful in related number grade marks of closely related composition. The Pluronic L-62 is presently used in a dosage of 1–5 ppm (preferred 2.5 ppm). The Pluronic L-62 assists in dispersing, especially at higher dosages of the sulfonated styrene maleic anhydride copolymer at 12.5 ppm. Diacid 1550 is a surfactant of a dimerized talloil produced by Emery.

In general the styrene polymers and phosphonates of this invention are water soluble and are utilized as water-treating agents. Additionally, the phosphonates are generally used in the form of the alkali metal and ammonium salts which are herewith incorporated as a part of the term phosphonate in this specification and claims.

The copolymer of styrene sulfonic acid with maleic anhydride or maleic acid is utilized preferably as a water-soluble copolymer having a molecular weight of from 1,500–2,000, and preferably, 2,000–15,000. Most preferably the polymer has a molecular weight of from 7,000–12,000. A further preference is that the styrene sulfonic acid moiety is 25–95 by weight percent of the polymer.

EXAMPLES

In order to show the progress my invention has made in the art, testing was performed using a pilot cooling tower "PCT" test as detailed in the paper "Small-Scale Short-Term Methods of Evaluating Cooling Water Treatments . . . Are They Worthwhile?", Proc. International Water Conference, Engineering Society of Western Pennsylvania 1976, 36, 1-12, which is hereinafter incorporated by reference. The water used in this test is described in Table 1 of my paper entitled "Performance Evaluation of Non-Metal Cooling Water Treatments", given at The International Corrosion Forum sponsored by the National Association of Corrosion Engineers, Anaheim Convention Center, Anaheim, California, April 18-22, 1983, which is also hereinafter incorporated by reference. Testing was accomplished by adding a product in the amount indicated to a given pilot cooling tower test. Those ingredients are shown for each test on Table 1.

Mild steel corrosion rates are shown for each of the eight (8) corrosion coupons, on Table 2. From the example and test work, corrosion is minimized using the compounds of this invention.

To further explain the example of this invention, tests numbered B, D and E show the effects of this invention. Test A, using the PBS-AM and AMP alone, and both C-1 and C-2 exemplify the method taught by U.S. Pat. No. 3,959,168. Examples F and H demonstrate the method exposed in U.S. Pat. No. 4,255,259 for the control of scale in aqueous systems containing low levels of hardness. Additional examples, G and I, show the effect of phosphonate alone on the control of corrosion. Based upon this data, it is believed that the novel combination proposed in this application is unique and provides superior corrosion protection in aqueous systems.

Applicants have discovered that the dosage rates previously indicated in this application are optimum both for performance and cost. Adding additional material to the cooling water does not appear to be beneficial to performance while adding levels below those amounts indicated does appear to be detrimental to performance.

It is important to note that compositions of this invention are formulated to prevent corrosion from occuring on metal surfaces in contact with cooling waters. In the example mentioned, little if any attention was paid to the scale forming tendencies of the various waters and treatments, although, when the system is properly controlled, scale should also be minimized.

TABLE 1

| Test No. | Dosage of Active Materials (ppm) PBS-AM | HEDP | AMP | TT | Diacid 1550 | Pluronic L-62 | TL-4 |
|---|---|---|---|---|---|---|---|
| A | 6 | 0 | 3.5 | 2 | 1.5 | 2.5 | 0 |
| B | 6 | 0 | 3.5 | 2 | 1.5 | 2.5 | 12.5 |
| C-1 | 6 | 4.2 | 0 | 2 | 1.5 | 2.5 | 0 |
| D | 6 | 4.2 | .0 | 2 | 1.5 | 2.5 | 12.5 |
| E | 6 | 4.2 | 0 | 2 | .5 | 0 | 7.5 |
| C-2 | 6 | 4.2 | .0 | 2 | .5 | 0 | 0 |
| F | 0 | 6.48 | 0 | 2 | 5 | 0 | 7.5 |
| G | 0 | 6.48 | 0 | 2 | 5 | 0 | 0 |

TABLE 1-continued

| Test No. | Dosage of Active Materials (ppm) PBS-AM | HEDP | AMP | TT | Diacid 1550 | Pluronic L-62 | TL-4 |
|---|---|---|---|---|---|---|---|
| H | 17 | 0 | 0 | 2 | .5 | 0 | 7.5 |
| I | 17 | 0 | 0 | 2 | .5 | 0 | 0 |

PBS-AM = 2-phosphonobutane-1,2,4-tricarboxylic acid
HEDP = Hydroxyethylidene 1,1-diphosphonic acid
AMP = Aminotrimethylene phosphonic acid
TT = Tolytriazole
Diacid 1550 = Surfactant
Pluronic L-62 = Surfactant
TL-4 = Sulfonated styrene maleic anhydride copolymer

TABLE II

| Test No. | Mild Steel Corrosion Rates (mpy) Specimen 1 | 2 | 3 | 4 | 5 | 6 | 7 | 8 | Av. |
|---|---|---|---|---|---|---|---|---|---|
| A | 5.9 | 6.0 | 2.5 | 6.1 | 5.2 | 4.3 | 6.5 | 4.3 | 5.1 |
| B | 1.4 | 0.9 | 1.7 | 1.5 | 0.8 | 1.2 | 1.2 | 1.0 | 1.2 |
| C-1 | 1.2 | 2.0 | 3.2 | 2.4 | 2.7 | 1.5 | 1.1 | 1.2 | 1.9 |
| C-2 | —* | — | 4.1 | 3.7 | 3.4 | 3.0 | 2.8 | 1.1 | 3.0 |
| D | 1.4 | 1.3 | 3.3 | 2.2 | 0.8 | 2.1 | 0.9 | 0.8 | 1.5 |
| E | — | — | 1.3 | 1.7 | 1.1 | 1.4 | 1.2 | 1.3 | 1.3 |
| F | — | — | 3.3 | 1.9 | 1.8 | 2.0 | 1.7 | 2.0 | 2.1 |
| G | — | — | 2.8 | 3.1 | 1.8 | 2.4 | 1.8 | 2.1 | 2.3 |
| H | — | — | 1.5 | 3.1 | 2.6 | 3.4 | 2.2 | 2.3 | 2.5 |
| I | — | — | 4.3 | 4.8 | 3.7 | —** | 3.4 | 4.6 | 4.2 |

A = PBS-AM, AMP, and L-62
B = PBS-AM, AMP, L-62 and Versa TL-4 (50 ppm)
C-1 = PBS-AM, HEDP, and L-62
C-2 = PBS-AM, and HEDP
D = PBS-AM, HEDP, L-62, and Versa TL-4 (50 ppm)
E = PBS-AM, HEDP, and Versa TL-4 (30 ppm)
F = HEDP and Versa TL-4 (30 ppm)
G = HEDP
H = PBS-AM and Versa TL-4 (30 ppm)
I = PBS-AM
*Blanks indicate no mild steel in this location
**Lost result Therefore we claim:

1. A composition for inhibiting ferrous metal corrosion in an aqueous system consisting essentially of a copolymer of styrene sulfonic acid and maleic anhydride or maleic acid and water-soluble salts of said copolymer; and a blend of two phosphonates consisting of (1) 2-phosphonobutane-1,2,4-tricarboxylic acid and (2) one member of the group consisting of (a) aminotrimethylene phosphonic acid, and (b) hydroxyethylidene 1,1-diphosphonic acid, with the copolymer being combined with the blend of phosphonates so as to provide in the aqueous system to be treated:

I. 7.5-15 ppm of the copolymers, and

II. 9.5-10.4 ppm of the blend of phosphonates, with the dosage of the blend of phosphonates being 6-12 ppm of (1) and 3.5-8.4 ppm of either 2(a) or 2(b).

2. The composition according to claim 1 which contains additionally an effective dispersing amount of a water soluble surfactant formed by condensing propylene oxide with propylene glycol.

3. A composition according to claim 1 wherein in the copolymer, the styrene sulfonic acid moiety is 25-95 weight percent and the molecular weight of the copolymer is about 1500-20,000.

* * * * *